US006245980B1

(12) United States Patent
May

(10) Patent No.: US 6,245,980 B1
(45) Date of Patent: Jun. 12, 2001

(54) CYMBAL PERFORMANCE SUPPORT AND CLAMP

(76) Inventor: Randall L. May, 8 Windsor, Newport Beach, CA (US) 92660

( * ) Notice: Subject to any disclaimer, the term of this patent is extended or adjusted under 35 U.S.C. 154(b) by 0 days.

(21) Appl. No.: 09/497,267

(22) Filed: Feb. 3, 2000

(51) Int. Cl.[7] ..... G10D 13/02
(52) U.S. Cl. ..... 84/422.3; 84/422.2; D20/10
(58) Field of Search ..... 84/421, 422.2, 84/422.3, 411 R, 453, 387 A, 380 R, 385 A, 329; 40/642.02, 644; D10/10–20

(56) References Cited

U.S. PATENT DOCUMENTS

D. 357,705 * 4/1995 Milojevich ..... D19/90
4,546,689 * 10/1985 Morana ..... 84/505
5,289,652 * 3/1994 Kringel et al. ..... 40/642
5,438,903 * 8/1995 Cropek ..... 84/422.3

FOREIGN PATENT DOCUMENTS

474469 * 4/1929 (DE) ..... 84/422.3

* cited by examiner

*Primary Examiner*—Robert E. Nappi
*Assistant Examiner*—Kim Lockett
(74) *Attorney, Agent, or Firm*—Neal J. Mosely

(57) ABSTRACT

A cymbal display and performance support includes a plurality of support rods having end portions for supporting cymbals. The support rods have a clamp secured over the cymbals and secured thereon to prevent removal of the cymbals. The clamp includes a slotted portion for receiving a display card indicating size, model number, price and the like.

17 Claims, 3 Drawing Sheets

CYMBAL PERFORMANCE SUPPORT AND CLAMP

BACKGROUND OF THE INVENTION

1. Field of the Invention

This invention relates generally to supports for cymbals and more particularly to a combined support and retaining clamp for cymbals.

2. Brief Description of the Prior Art

Tripod supports are well known for holding cymbals for playing in an orchestra.

Cymbal display supports are also well known for exhibiting cymbals in stores or otherwise in marketing them. Prouty U.S. Pat. No. 4,666,110 discloses a collapsible holder for cymbals to be stored for use close to the percussionist (cymbal player) in the orchestra. No suggestion is made of any storage apparatus for use in display or exhibition of cymbals in marketing.

The present invention is distinguished over the prior art in general, and this patent in particular, by providing a cymbal display and performance support that includes a clamp securing cymbals against removal and providing a holder for supporting a display card having indicia showing size, model number, price and the like.

SUMMARY OF THE INVENTION

It is therefore an object of the present invention to provide a new and improved support for cymbals for exhibition or display.

It is another object of this invention to provide a new and improved support for cymbals for exhibition or display that is simple in construction and inexpensive to produce.

Another object of this invention is to provide a new and improved support for cymbals for exhibition or display that includes a clamp for securing cymbals against removal.

Another object of this invention is to provide a new and improved support cymbals for exhibition or display that includes a clamp for securing cymbals against removal and provides a holder for a display card.

Other objects of the invention will become apparent from time to time throughout the specification and claims as hereinafter related.

The above noted objects and other objects of the invention are accomplished by a cymbal display and performance support that includes a plurality of support rods having end portions for supporting cymbals. The support rods have a clamp secured over the cymbals and secured thereon to prevent removal of the cymbals. The clamp includes a slotted portion for receiving a display card indicating size, model number, price and the like.

DESCRIPTION OF A PREFERRED EMBODIMENT

Figure 1:
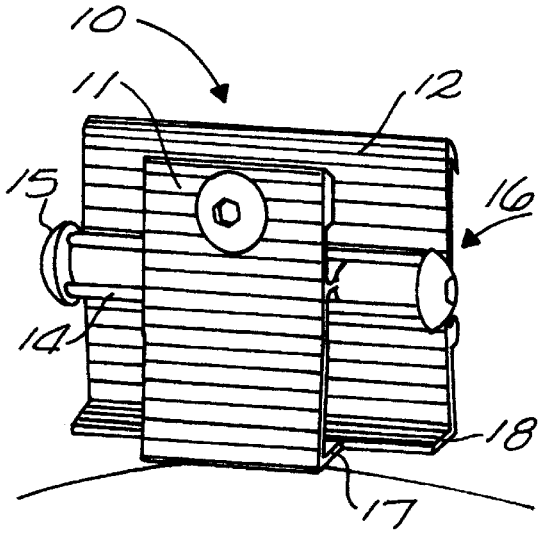
FIG. 1 is a rear isometric view of a clamp for securing a cymbal on a support with an Allan wrench in place for locking the clamp.

Referring to the drawings by numerals of reference, there is shown one preferred embodiment of a support for performance, display and exhibit of cymbals and a clamp for securing the cymbals in place and supporting a display card.

Cymbal clamp 10 comprises a pair of plates forming jaws 11 and 12 with mating supports 13 and 14 fitted together by pin 15 to provide a hinge 16 allowing pivotal movement of the jaws. Jaws 11 and 12 each have inturned flanges 17 and 18 that grip a supporting post for the cymbals when locked in place. Flanges 17 and 18 each have an arcuate cutout or indentation 19 to fit around a post on which the clamp is to be positioned.

Jaw 12 has a pair of spaced grooves or extrusions 20 providing a holder for a display card 21 to be assembled therein to show model number, size, price, and the like. A screw or bolt 22 is positioned threadedly in jaw 11 for movement toward or away from jaw 12, The head 23 of bolt 22 has an Allan recess 24 for tightening or loosening by an Allan wrench 25. An alternate embodiment in FIG. 4 substitutes a thumb operated screw or bolt 26 for Allan bolt 22.

Figure 6:
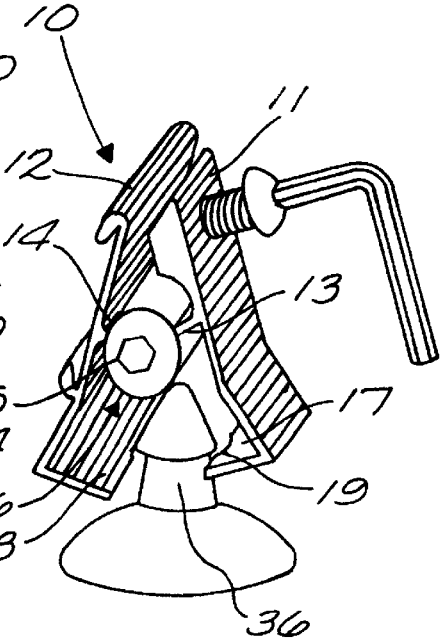
FIG. 6 is a side isometric view of a cymbal clamp as shown in FIG. 1 showing a cymbal about to be clamped on a supporting post having a rubber or plastic tip shaped to receive the clamp.
Figure 7:
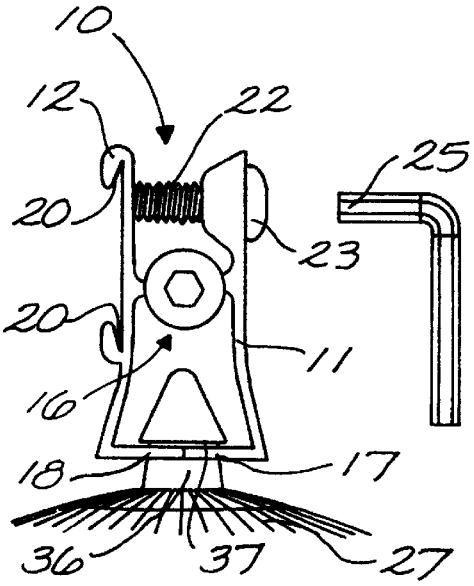
FIG. 7 is a view in side elevation of the cymbal clamp and supporting tip shown in FIG. 6 locked in clamping position.

Clamps 10 are used to secure cymbals 27 on the upright posts of a cymbal rack 28 or other cymbal support. Post 29 may be the upturned portion of a support rod 30 extending from rack 28 or may be a post 31 pivotally connected to rod 30 as at 32 in FIG. 2. Knurled and threaded nuts or washers 33 and 34 assist in securing cymbals 27 in place and are spaced to permit insertion of jaws 11 and 12 of clamps 10 therebetween. In an alternate embodiment, shown in FIGS. 6 and 7, a tip member 36 of rubber or plastic material is fitted over the upwardly extending ends of posts 29. Tip members 36 have a peripheral groove 37 into which the jaws 11 and 12 of clamps 10 fit when the clamp is assembled.

OPERATION

While the operation of this invention should be obvious from the description of the preferred embodiment, it will be restated herein for clarity.

Figure 2:
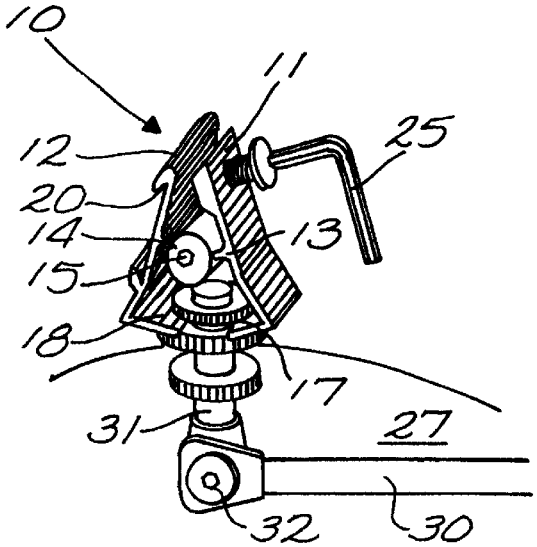
FIG. 2 is a side isometric view of a cymbal clamp as shown in FIG. 1 showing a cymbal about to be clamped on a supporting post.
Figure 3:
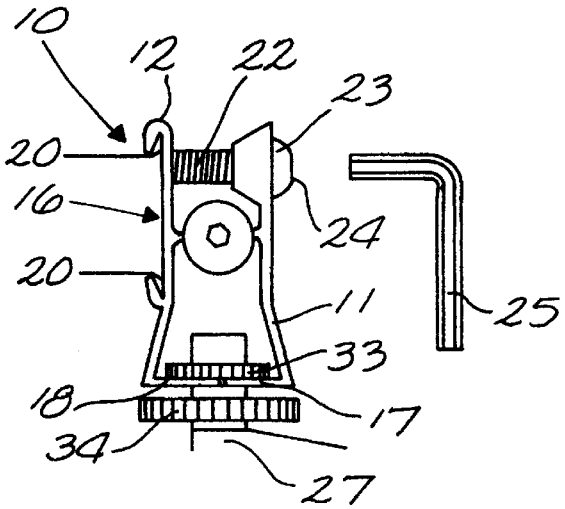
FIG. 3 is a view in side elevation of the cymbal clamp or FIGS. 1 and 2 locked in clamping position.
Figure 4:
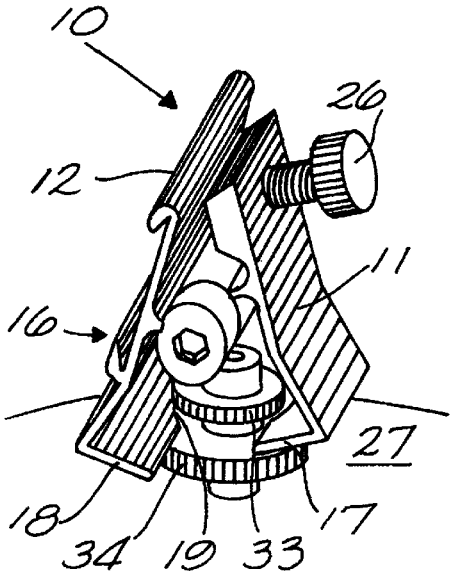
FIG. 4 is a side isometric view of the clamp of FIG. 2 modified by having a thumb operated screw replacing the Allan screw.
Figure 5:
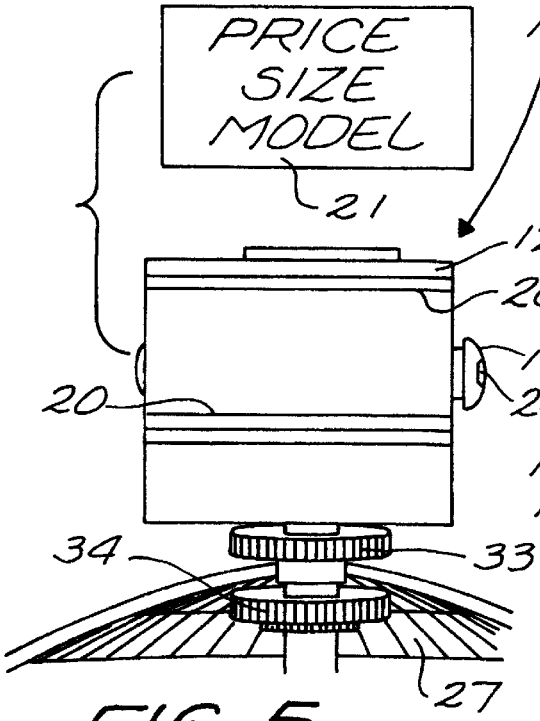
FIG. 5 is a view in front elevation of the cymbal, supporting post and clamp of FIG. 1 showing the slot for supporting a display card in exploded relation.
Figure 8:
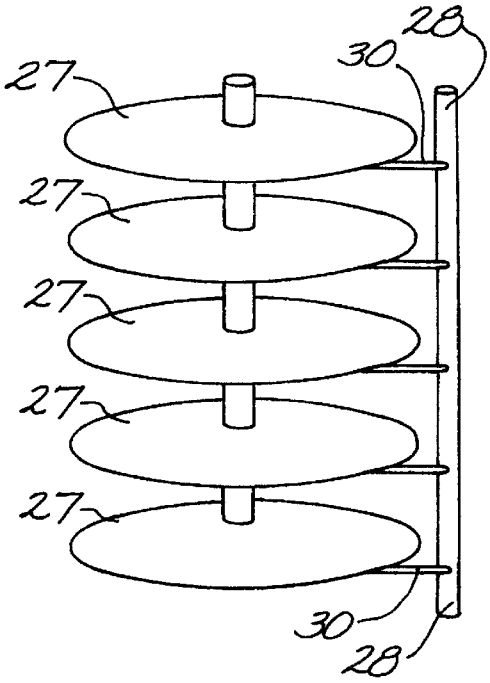
FIG. 8 is a view in side elevation of a plurality of cymbals on supporting arms and posts secured by the clamp of FIGS. 1–7.
Figure 9:
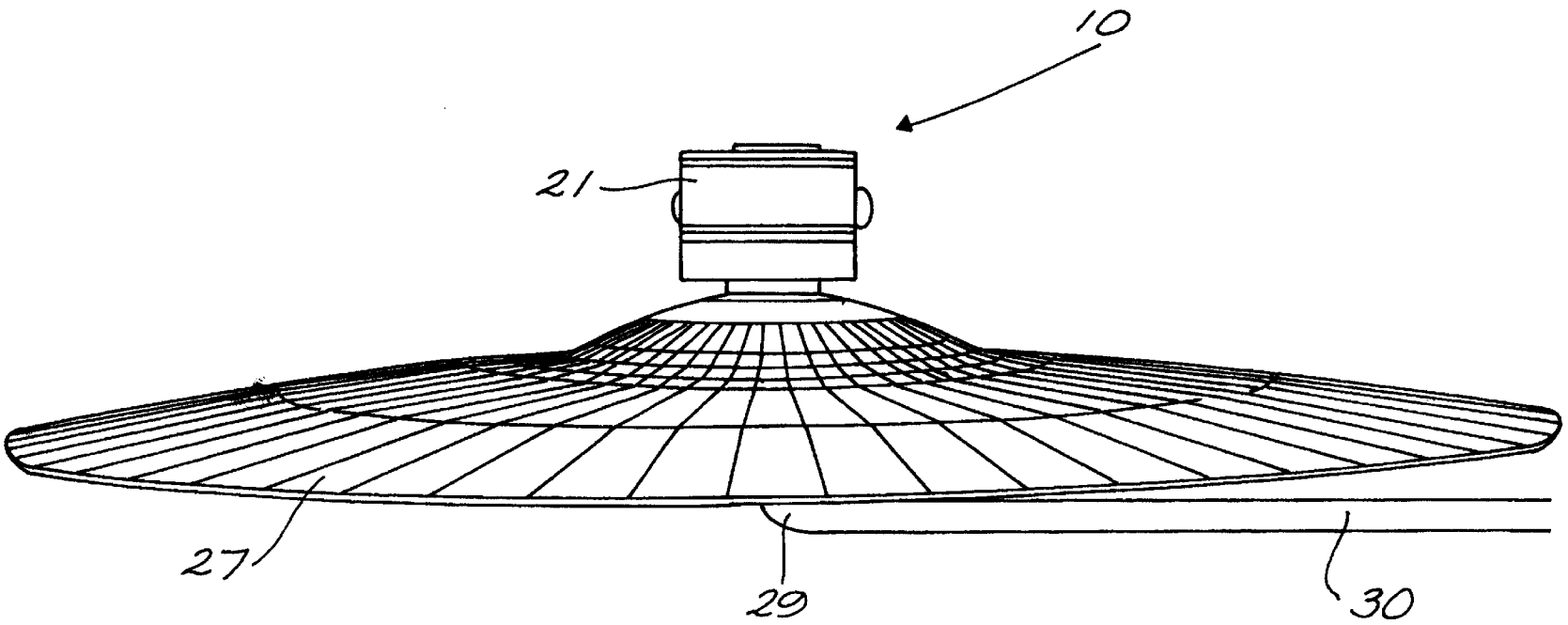
FIG. 9 is a view in side elevation of one of the cymbals and clamp of FIG. 8, and showing a display card supported on the clamp.

Clamps 10 each have a retracted position as seen in FIGS. 2, 4 and 8. Cymbals 27 are each positioned on upright posts 29 or 31 and retained by nuts or washers 33 and 34 or plastic or rubber tip 37. Clamps 10 are positioned over the ends of the posts and the screws or bolts tightened by Allan wrench (in the embodiment of FIG. 2) or by knurled thumbscrew 26 (in the embodiment of FIG. 4). When completely tightened, the clamps 10 are locked in place with flanges 17 and 18 clamped against the posts. The display cards 21 are slid into place between slots 20 and show model number, size, and price of the cymbals.

While this invention has been shown fully and completely with special emphasis on a preferred embodiment, it should be understood that, within the scope of the appended claims, the invention may be practiced otherwise than as specifically described herein.

What is claimed is:

1. A cymbal display and performance support and securing clamp, comprising an elongated upward extending support member, a cymbal supporting member supported on and extending from said upward extending support member and having a vertically extending end portion, a cymbal supported on said vertically extending end portion, and a clamp member secured on said vertically extending end portion clamping and locking said cymbal in place, said clamp member comprising a pair of jaw members pivotally connected together and having a relaxed position and a clamping position, and said jaw members having inturned flange end portions operable to clamp said vertically extending end portion when moved to said clamping position.

2. A cymbal display and performance support and securing clamp to claim 1 in which one of said jaw members has a display card secured thereon.

3. A cymbal display and performance support and securing clamp to claim 1 including a threaded operating member extending through one of said jaw members and engageable with the other jaw member and operable to move said jaw members between said relaxed position and said clamping position.

4. A cymbal display and performance support and securing clamp to claim 1 including an Allan screw or bolt extending through one of said jaw members and engageable with the other jaw member and operable to move said jaw members between said relaxed position and said clamping position.

5. A cymbal display and performance support and securing clamp to claim 1 including a thumbscrew or thumb-operated bolt extending through one of said jaw members and engageable with the other jaw member and operable to move said jaw members between said relaxed position and said clamping position.

6. A cymbal display and performance support and securing clamp to claim 1 in which a one jaw member has a pair of spaced grooves receiving said display card to secure it in position.

7. A cymbal display and performance support and securing clamp to claim 1 in which said upwardly extending member includes a peripheral groove into which said clamp member jaws are secured on assembly.

8. A cymbal display and performance support and securing clamp to claim 7 in which said upwardly extending member peripheral groove is formed by a pair of threaded washers or nuts secured thereon.

9. A cymbal display and performance support and securing clamp to claim 7 in which said upwardly extending member peripheral groove is formed by a hollow rubber or plastic tip member fitted thereon and having a peripheral groove.

10. A securing clamp member for use with a cymbal display and performance support having an elongated upward extending support member, a cymbal supporting member supported on and extending from said upward extending support member and having a vertically extending end portion, and a cymbal supported on said vertically extending end portion, said clamp member being operable to be secured on said vertically extending end portion clamping and locking said cymbal in place, and comprising a pair of jaw members pivotally connected together and having a relaxed position and a clamping position, said jaw members having inturned flange end portions operable to clamp said vertically extending end portion when moved to said clamping position, and one of said jaw members having a display card secured thereon.

11. A clamp member according to claim 10 in which said one jaw member has a pair of spaced grooves receiving said display card to secure it in position.

12. A clamp member according to claim 10 including a threaded operating member extending through one of said jaw members and engageable with the other jaw member and operable to move said jaw members between said relaxed position and said clamping position.

13. A clamp member according to claim 10 including an Allan screw or bolt extending through one of said jaw members and engageable with the other jaw member and operable to move said jaw members between said relaxed position and said clamping position.

14. A clamp member according to claim 10 including a thumbscrew or thumb-operated bolt extending through one of said jaw members and engageable with the other jaw member and operable to move said jaw members between said relaxed position and said clamping position.

15. A clamp member according to claim 11 including a threaded operating member extending through one of said jaw members and engageable with the other jaw member and operable to move said jaw members between said relaxed position and said clamping position.

16. A clamp member according to claim 11 including an Allan screw or bolt extending through one of said jaw members and engageable with the other jaw member and operable to move said jaw members between said relaxed position and said clamping position.

17. A clamp member according to claim 11 including a thumbscrew or thumb-operated bolt extending through one of said jaw members and engageable with the other jaw member and operable to move said jaw members between said relaxed position and said clamping position.

* * * * *